US008539977B2

(12) United States Patent
Yamamoto et al.

(10) Patent No.: US 8,539,977 B2
(45) Date of Patent: Sep. 24, 2013

(54) SLIDE VALVE APPARATUS FOR AUTOMATIC APPLICATION OF SURFACE PRESSURE AND SURFACE PRESSURE APPLICATION METHOD THEREOF

(75) Inventors: Kenji Yamamoto, Tokyo (JP); Mototsugu Osada, Tokyo (JP); Atsushi Takata, Tokyo (JP)

(73) Assignee: Shinagawa Refractories Co., Ltd., Tokyo (JP)

( * ) Notice: Subject to any disclaimer, the term of this patent is extended or adjusted under 35 U.S.C. 154(b) by 35 days.

(21) Appl. No.: 13/496,352

(22) PCT Filed: Dec. 1, 2010

(86) PCT No.: PCT/JP2010/071462

§ 371 (c)(1), (2), (4) Date: Mar. 15, 2012

(87) PCT Pub. No.: WO2011/077912

PCT Pub. Date: Jun. 30, 2011

(65) Prior Publication Data

US 2012/0175542 A1 Jul. 12, 2012

(30) Foreign Application Priority Data

Dec. 25, 2009 (JP) ..... 2009-294034

(51) Int. Cl.
*B22D 41/34* (2006.01)

(52) U.S. Cl.
USPC ..... 137/553; 222/601; 251/284; 251/326

(58) Field of Classification Search
USPC ..... 251/326–329, 284–285; 137/553; 222/600, 601, 606
See application file for complete search history.

(56) References Cited

U.S. PATENT DOCUMENTS

| | | | | |
|---|---|---|---|---|
| 3,511,261 | A * | 5/1970 | Bick et al. | 251/326 |
| 4,042,207 | A * | 8/1977 | Nehrlich et al. | 222/600 |
| 4,573,616 | A * | 3/1986 | Shapland | 222/600 |
| 5,582,391 | A * | 12/1996 | McNair et al. | 251/326 |
| 6,978,980 | B2 * | 12/2005 | Plattner et al. | 251/327 |
| 2009/0184139 | A1 | 7/2009 | Mitsui et al. | |

FOREIGN PATENT DOCUMENTS

| | | |
|---|---|---|
| CA | 2255123 | 6/1999 |
| JP | 7-80631 | 3/1995 |
| JP | 11-179531 | 7/1999 |
| JP | 2007-326120 | 12/2007 |

OTHER PUBLICATIONS

International Search Report issued Feb. 8, 2011 in International (PCT) Application No. PCT/JP2010/071462.

* cited by examiner

*Primary Examiner* — John K Fristoe, Jr.
(74) *Attorney, Agent, or Firm* — Wenderoth, Lind & Ponack, LLP

(57) ABSTRACT

In order to simplify work of applying and releasing a surface pressure in a slide valve device constructed of a fixed plate, a slide plate, a seal plate, and the like, provided is a slide valve device for automatic surface pressure application and a surface pressure application method therefor, the slide valve device including: a base frame (2) including a positioning member (51) for determining an arrangement location (X) of a seal case (21) and a stopper (52) for fixing the seal case (21) at the arrangement location (X); and a slide case (4) including a pusher (53) for sliding the seal case (21) together with the slide case (4) when sliding the slide case (4) in a surface pressure application direction.

5 Claims, 17 Drawing Sheets

[ RELEASE POSITION OF SEAL CASE 21 ]

[ USE POSITION ( FULLY CLOSED POSITION-BACKLASH ) ]

[ USE POSITION ( FULLY OPENED POSITION ) ]

[ STOPPER OPERATION POSITION ]

( PRIOR ART )

(PRIOR ART)

[ FULLY OPENED STATE ]

( PRIOR ART )

( PRIOR ART )

SLIDE VALVE APPARATUS FOR AUTOMATIC APPLICATION OF SURFACE PRESSURE AND SURFACE PRESSURE APPLICATION METHOD THEREOF

TECHNICAL FIELD

The present invention relates to a slide valve device for automatic surface pressure application, and to a surface pressure application method therefor. In particular, the present invention relates to a novel improvement for simplifying work of surface pressure application in a slide valve device constructed of a fixed plate, a slide plate, and a seal plate.

BACKGROUND ART

In general, in continuous casting facilities, as means for controlling outflow of a molten metal from a molten metal vessel, a slide valve device for opening and closing an outflow port of the molten metal vessel is provided at a bottom portion of the molten metal vessel.

As the slide valve device, the applicant of the present invention has invented and developed a slide valve device constructed of a fixed plate, a slide plate, and a seal plate (Patent Literature 1).

Specifically, as illustrated in FIGS. 14 and 15, a slide valve device 20 disclosed in Patent Literature 1 includes a base frame 2 for fixing a fixed plate 3, the base frame 2 being fixed to a bottom lower surface 1*a* of a molten metal vessel 1, a slide case 4 including a slide plate 5, the slide case 4 being positioned below the fixed plate 3, a seal case 21 including a seal plate 6 or including a seal plate 6 and a shooting nozzle 21*a*, the seal case 21 being positioned below the slide plate 5, and an actuator 7 for sliding the slide case 4. In the slide valve device 20, the slide case 4 and the seal case 21 are coupled to each other by coupling means 23, and the slide case 4 and the seal case 21 are integrally slid so that a surface pressure is appliable and releasable.

Further, as illustrated in FIG. 17, the slide valve device 20 includes a rotatable stopper 52 for fixing the seal case 21 situated at an arrangement location so that the seal case 21 is not moved.

As illustrated in FIG. 16, in a state in which the surface pressure is applied, the seal plate 6 is biased upward by the seal case 21 including rollers (movable members) 14 slidable on support surfaces 13 situated at side portions of the base frame including springs 12. Accordingly, the fixed plate 3, the slide plate 5, and the seal plate 6 are brought into press contact with each other with a predetermined pressing force. As a result, leakage of a molten metal and intrusion of air through nozzle holes 3*a*, 5*a*, and 6*a* of the respective plates 3, 5, and 6 may be prevented.

CITATION LIST

Patent Literature

[PTL 1] JP 2007-326120 A

SUMMARY OF INVENTION

Technical Problem

The slide valve device disclosed in Patent Literature 1 (hereinafter, referred to as "device of Patent Literature 1") is structured as described above, and hence the following problem is inherent therein.

That is, in the device of Patent Literature 1, when the surface pressure is applied and released, the slide case 4 and the seal case 21 need to be coupled to each other using a connecting pin serving as the coupling means 23. Therefore, the structure of the device becomes complicated and the work involved becomes cumbersome. Further, in order to rotate the stopper 52, a certain size of clearance is necessary, but due to this clearance, the seal case may move in a little gap during the casting.

Solution to Problem

The present invention provides a slide valve device for automatic surface pressure application, including: a fixed plate fixed inside a base frame that is mounted onto a bottom lower surface of a molten metal vessel; a slide case including a slide plate, the slide case being provided below the fixed plate so as to be slidable by an actuator; a seal case provided below the slide case, the seal case including a seal plate or including a seal plate and a shooting nozzle; and a movable member provided to each side portion of the seal case so as to be movable on a support surface situated at each side portion of the base frame, the slide case and the seal case being slidable by the actuator so that a surface pressure is appliable and releasable, in which the base frame includes: a positioning member for determining an arrangement location of the seal case; and a stopper for fixing the seal case at the arrangement location, and in which the slide case or a guide piece includes a pusher for sliding the seal case together with the slide case when sliding the slide case in a surface pressure application direction. Further, the positioning member and the stopper are arranged so as to sandwich the seal case with respect to a sliding direction of the slide case. Further, a contact portion of the positioning member with respect to the seal case forms a pressing portion having elasticity. Further, the present invention provides a surface pressure application method for a slide valve device for automatic surface pressure application, the slide valve device for automatic surface pressure application including: a fixed plate fixed inside a base frame that is mounted onto a bottom lower surface of a molten metal vessel; a slide case including a slide plate, the slide case being provided below the fixed plate so as to be slidable by an actuator; a seal case provided below the slide case, the seal case including a seal plate or including a seal plate and a shooting nozzle; and a movable member provided to each side portion of the seal case so as to be movable on a support surface situated at each side portion of the base frame, the slide case and the seal case being slidable by the actuator so that a surface pressure is appliable and releasable, the base frame of the slide valve device for automatic surface pressure application including: a positioning member for determining an arrangement location of the seal case; and a stopper for fixing the seal case at the arrangement location, the guide piece or a slide case of the slide valve device for automatic surface pressure application including a pusher provided for pushing or drawing the seal case, the surface pressure application method including: sliding the slide case in a surface pressure application direction to move the seal case to the arrangement location together with the slide case through the intermediation of the pusher; and fitting the stopper to the seal case that has been moved to the arrangement location to fix the seal case at the arrangement location.

Advantageous Effects of Invention

The slide valve device for automatic surface pressure application and the surface pressure application method therefor according to the present invention are structured and configured as described above, and hence the following effects can be obtained.

That is, in the slide valve device for automatic surface pressure application, including: the fixed plate fixed inside the base frame that is mounted onto the bottom lower surface of the molten metal vessel; the slide case including the slide plate, the slide case being provided below the fixed plate so as to be slidable by the actuator; the seal case provided below the slide case, the seal case including the seal plate or including the seal plate and the shooting nozzle; and the movable member provided to the each side portion of the seal case so as to be movable on the support surface situated at the each side portion of the base frame, the slide case and the seal case being slidable by the actuator so that the surface pressure is appliable and releasable, the base frame includes: the positioning member for determining the arrangement location of the seal case; and the stopper for fixing the seal case at the arrangement location, and the slide case or a guide piece includes the pusher for sliding the seal case together with the slide case when sliding the slide case in the surface pressure application direction.

Further, the positioning member and the stopper are arranged so as to sandwich the seal case with respect to the sliding direction of the slide case. Further, the contact portion of the positioning member with respect to the seal case forms the pressing portion having elasticity. Further, in the surface pressure application method for the slide valve device for automatic surface pressure application, the slide valve device for automatic surface pressure application including: the fixed plate fixed inside the base frame that is mounted onto the bottom lower surface of the molten metal vessel; the slide case including the slide plate, the slide case being provided below the fixed plate so as to be slidable by the actuator; the seal case provided below the slide case, the seal case including the seal plate or including the seal plate and the shooting nozzle; and the movable member provided to the each side portion of the seal case so as to be movable on the support surface situated at the each side portion of the base frame, the slide case and the seal case being slidable by the actuator so that the surface pressure is appliable and releasable, the base frame of the slide valve device for automatic surface pressure application including: the positioning member for determining the arrangement location of the seal case; and the stopper for fixing the seal case at the arrangement location, the slide case or the guide piece of the slide valve device for automatic surface pressure application including the pusher provided for pushing or drawing the seal case, by sliding the slide case in the surface pressure application direction, the seal case can be moved to the arrangement location together with the slide case through the intermediation of the pusher, and by fitting the stopper to the seal case that has been moved to the arrangement location, the seal case can be fixed at the arrangement location. The seal case can be pushed by the pusher, and hence, unlike the conventional case, the work of applying and releasing the surface pressure can be performed without coupling the slide case and the seal case to each other by the coupling means. Further, the seal case is pushed by the pusher until the seal case reaches the positioning member, and hence the seal case can be moved to the arrangement location with high accuracy. Further, the positioning member is provided opposite to the stopper with respect to the sliding direction, and hence the seal case can be fixed at the arrangement location by the positioning member and the stopper so that the seal case is not moved during operation. Further, when the contact portion of the positioning member with respect to the seal case is the pressing portion having elasticity, due to deformation of the pressing portion as an elastic member, a clearance, that is, a backlash, which is necessary to move the stopper, can be ensured. In addition, due to an elastic force of the pressing portion as an elastic member, the seal case is pressed against the stopper, and as a result, it is possible to prevent the seal case from moving during operation due to the clearance.

DESCRIPTION OF EMBODIMENTS

It is an object of the present invention to provide a slide valve device for automatic surface pressure application that is constructed of a fixed plate, a slide plate, and a seal plate, and a surface pressure application method therefor, which are capable of simplifying work of applying and releasing a surface pressure by using a pusher and a positioning member instead of using a coupling pin as in the conventional case.

Embodiments

In the following, a slide valve device for automatic surface pressure application and a surface pressure application method therefor according to a preferred embodiment of the present invention are described with reference to the drawings.

Note that, the same or similar components as those in the conventional example are represented by the same reference symbols when being described.

Figure 1:
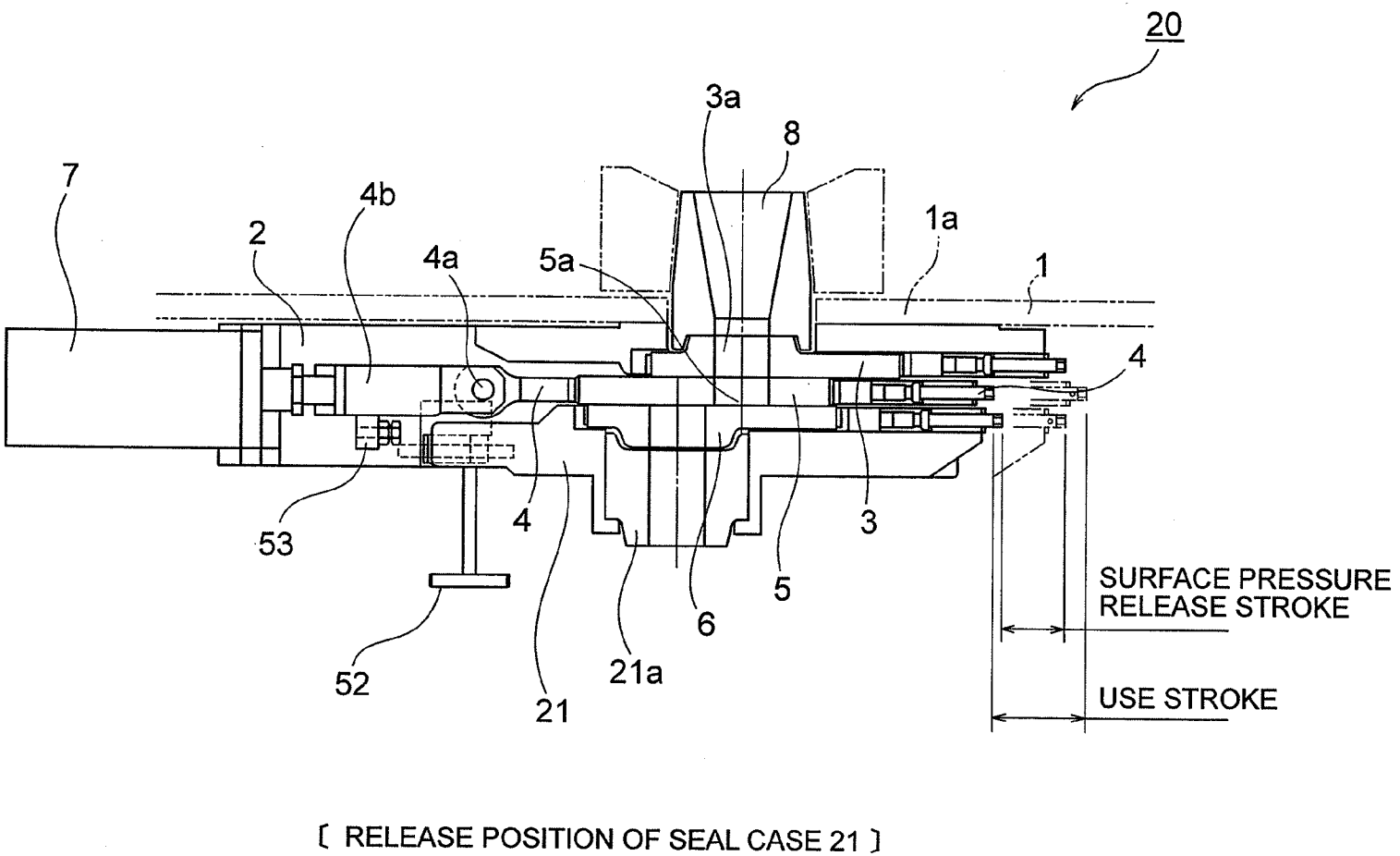
FIG. 1A sectional view of a slide valve device for automatic surface pressure application according to the present invention.
Figure 2:
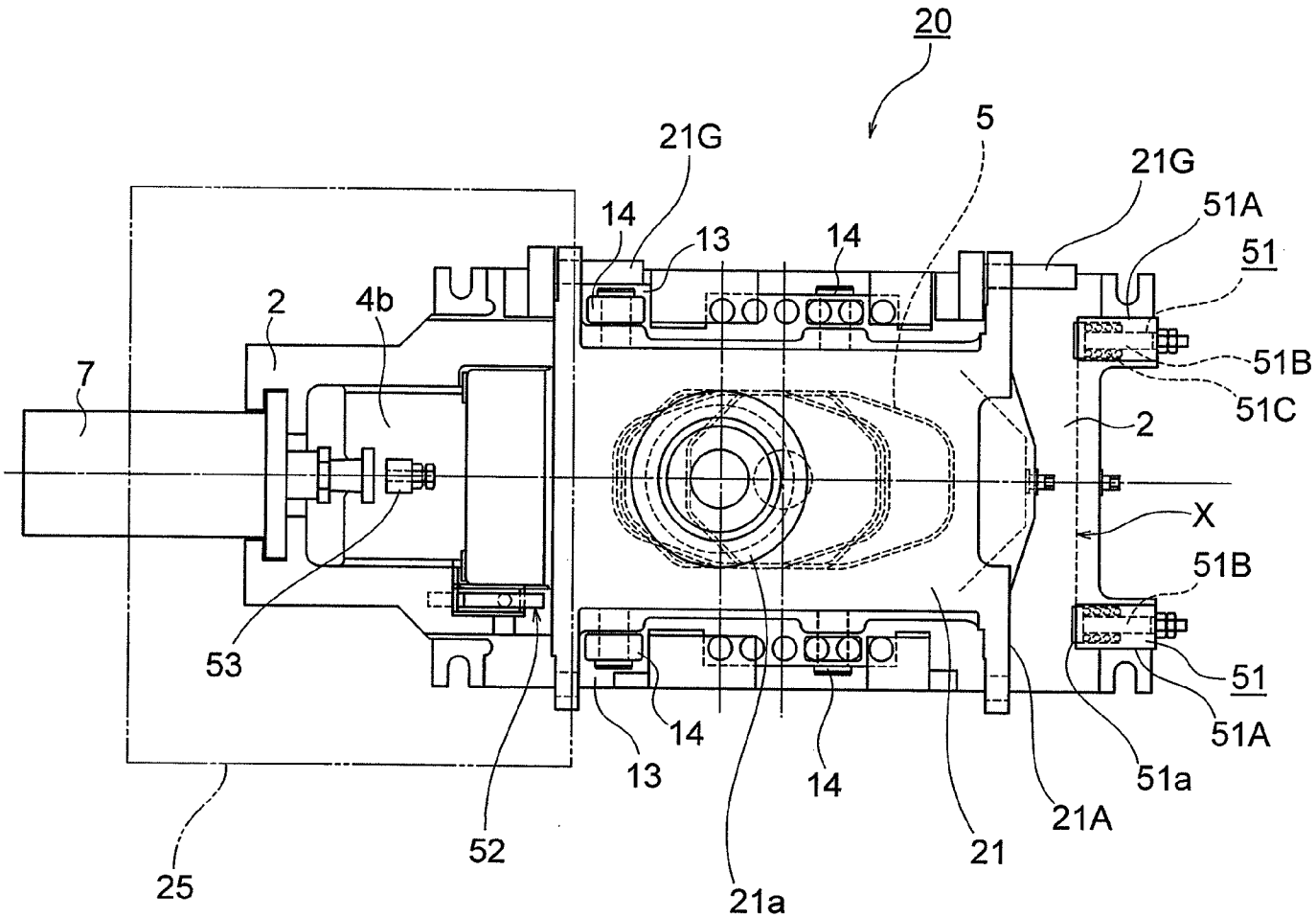
FIG. 2 A bottom view of FIG. 1.

FIGS. 1 and 2 illustrate a release position of a seal case 21 of a slide valve device 20. On a bottom lower surface 1*a* of a molten metal vessel 1, a fixed plate 3 having a nozzle hole 3*a* communicating to an insertion nozzle 8 is provided through the intermediation of a base frame 2.

Below the fixed plate 3, a slide case 4 including a slide plate 5 provided with a nozzle hole 5*a* is connected through the intermediation of a guide piece 4*b* to a hydraulic or electrical actuator 7. With the activation of the actuator 7, only the slide case 4 is independently slidable together with the slide plate 5 in a horizontal direction in FIG. 1.

The slide case 4 can be turned downward in FIG. 1 owing to an axial support portion 4*a* provided on the guide piece 4*b* side. A seal case 21 including a seal plate 6 below the slide case 4 is openable and closable through the intermediation of an axial support portion 21G. Therefore, the slide case 4 can be turned after the seal case 21 is released. Note that, the seal case 21 includes only the seal plate 6, or alternatively includes the seal plate 6 and a shooting nozzle 21*a*.

On a lower surface of the slide case 4 or the guide piece 4*b*, a pusher 53 formed of a protruding member is provided. When the slide case 4 is slid in a surface pressure application direction by the actuator 7, the seal case 21 is slidable together with the slide case 4 by the pusher 53.

Further, at an end portion of the base frame 2 which is opposite to the actuator 7, a pair of positioning members 51 are provided so as to determine an arrangement location X of the seal case 21 described later.

Further, a stopper 52 is provided to the base frame 2 on the pusher 53 side. The stopper 52 is capable of fixing the seal case 21 at the arrangement location. Note that, the positioning members 51 and the stopper 52 sandwich the seal case 21 along a sliding direction of the slide case 4.

Figure 9:
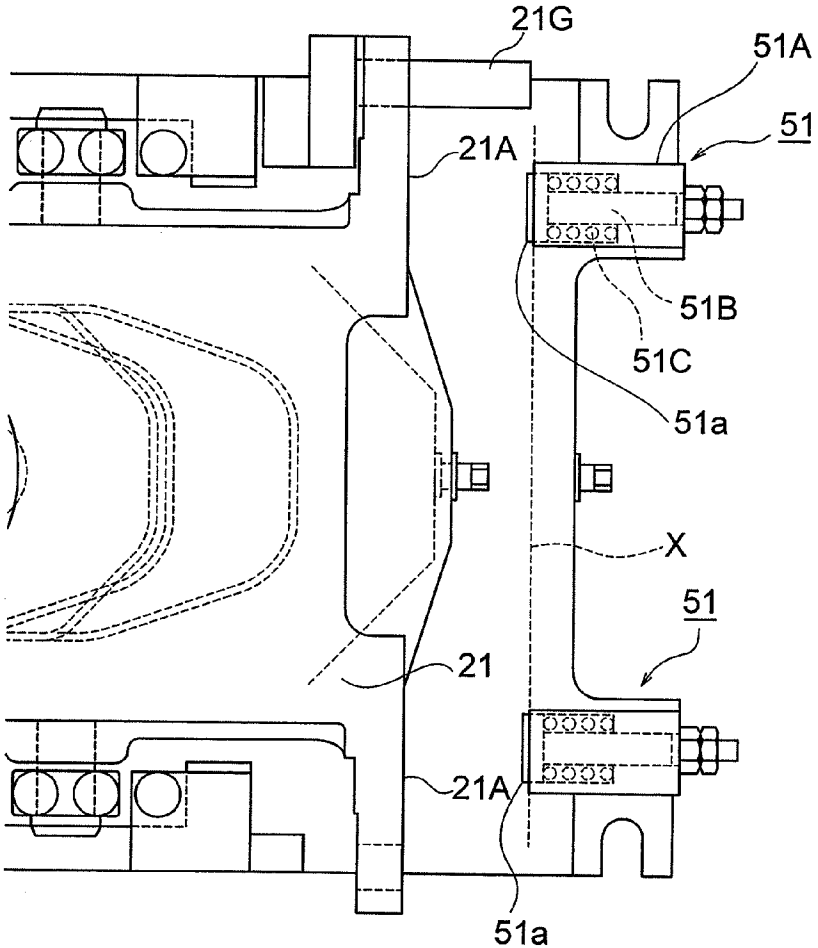
FIG. 9 An enlarged view of a main part of FIG. 2.

As illustrated in FIG. 2 and FIG. 9, which is an enlarged view of FIG. 2, in each of the positioning members 51, an operation member 51B having a T-shape in cross section is provided inside a cylindrical member 51A so as to be operable in an axial direction thereof through the intermediation of a compression spring 51C. At a tip end of the operation member 51B, a contact portion 51*a* is provided, which is constructed of a pressing portion formed of an elastic member.

The contact portion 51*a* is formed so as to protrude forward from an end portion of the cylindrical member 51A, and is made of such a material that the contact portion 51*a* is deformed and pressed when a tip end 21A of the seal case 21 abuts against the contact portion 51*a*, and then the seal case 21 is slightly moved (biased) back in a direction of the original position of the seal case 21.

Note that, the positioning member 51 is not limited to the structure using the cylindrical member 51A, the compression spring 51C, and the like described above. For example, although illustration is omitted herein, the positioning member 51 may have a structure using only an integrally molded member having a rod shape or a T-shape in cross section, which is made of a rubber or resin material, or using only a spring. With this structure, actions and effects similar to those described above can be obtained.

Figure 6:
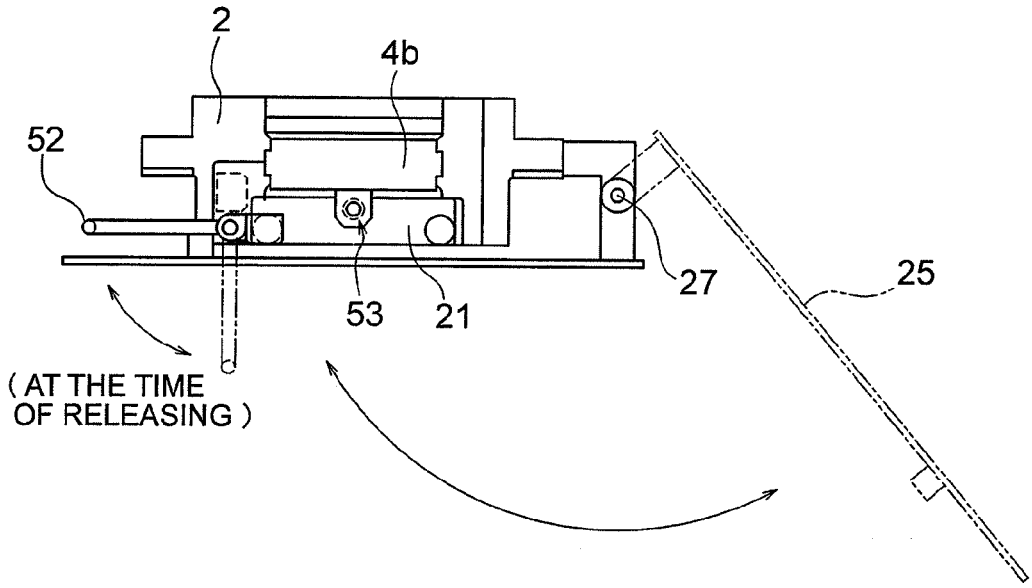
FIG. 6 A sectional view taken in the arrow B direction of FIG. 4.

FIG. 2 is a bottom view of FIG. 1. The base frame 2 is provided with the well-known stopper 52 pivotable only by 90 degrees from a horizontal direction to a vertical direction and vice versa. Below the stopper 52, a plate-like heat insulating cover 25 is provided pivotably toward the base frame 2 through the intermediation of an axial support portion 27 as illustrated in FIG. 6. Note that, the stopper 52 is used for limiting a sliding range of the seal case 21 by causing the seal case 21 to abut against a protrusion or the like (not shown) during sliding.

Further, as illustrated in FIG. 6, the heat insulating cover 25 is allowed to assume a closing state when the stopper 52 is situated at a horizontal position (solid line), and is not allowed to assume the closing state when situated at a vertical position (dotted line).

Next, description is given of a case of operations of applying and releasing the surface pressure, which are performed by the slide valve device 20 according to the present invention structured as described above.

First, in a fully opened state (not shown) of the slide valve device 20 of the present invention, when a molten steel or a molten metal flows through the insertion nozzle 8, only the slide case 4 is slid by means of the actuator 7, whereby it is possible to perform control and an OFF operation of the molten metal which flows from the insertion nozzle 8 into the shooting nozzle 21*a* through the nozzle holes 3*a* and 5*a*.

Figure 3:
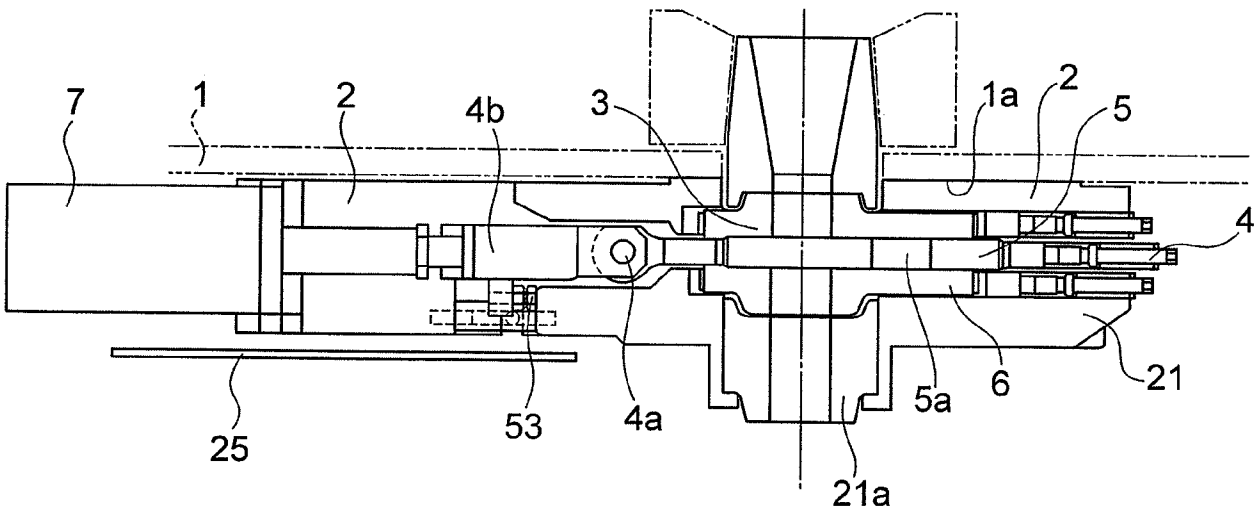
FIG. 3 A sectional view illustrating a fully closed state of FIG. 1.
Figure 4:
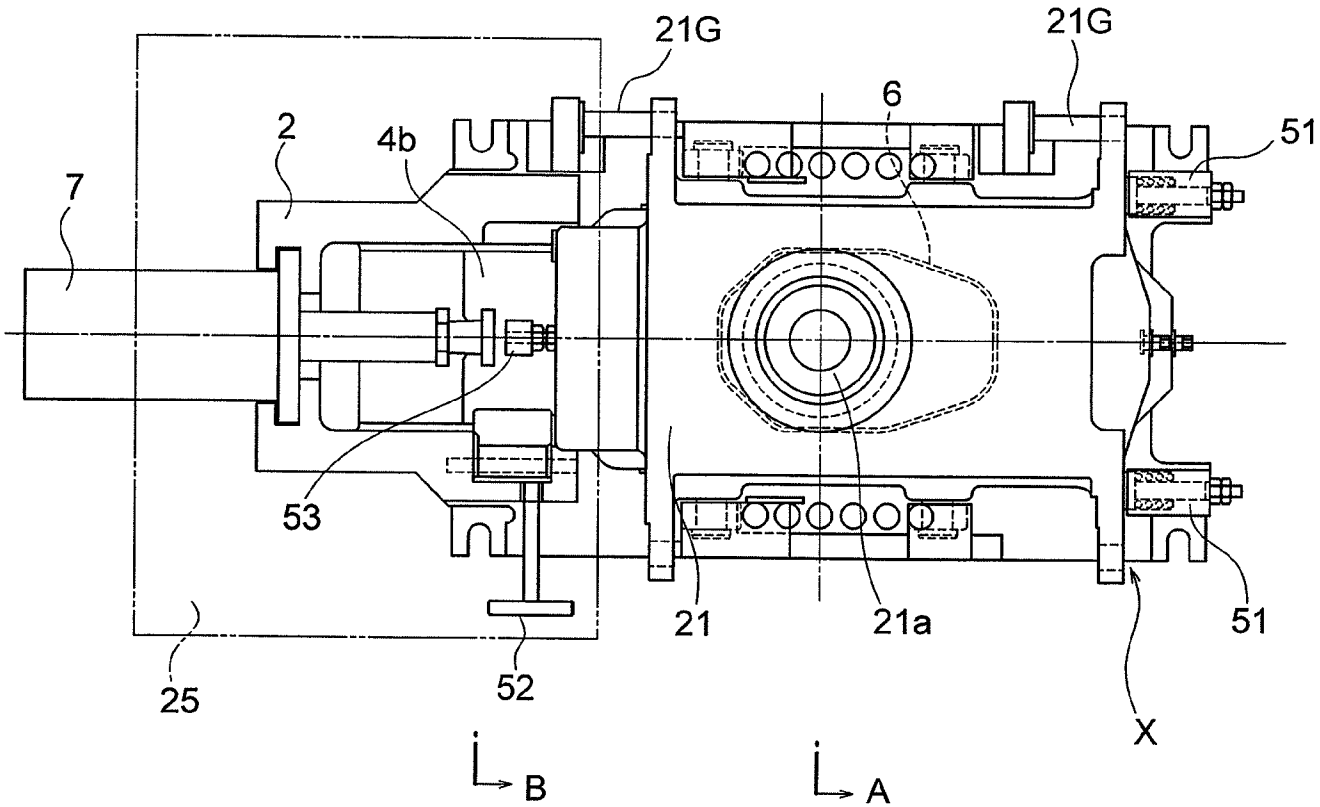
FIG. 4 A bottom view of FIG. 3.

In the above-mentioned case, the positioning members 51 for determining the arrangement location X of the seal case 21, and the stopper 52 for fixing the seal case 21 at the arrangement location X are provided to the base frame 2, while the pusher 53 for pushing the seal case 21 is provided to the slide case 4 or the guide piece 4*b*. Therefore, when the slide case 4 or the guide piece 4*b* is slid in the surface pressure application direction by the actuator 7, as illustrated in FIGS. 3 and 4, the seal case 21 is moved to the arrangement location X together with the slide case 4 by the pusher 53, and the stopper 52 is fitted to the seal case 21 that has been moved to the arrangement location X, with the result that the seal case 21 can be fixed at the arrangement location X. Note that, the positioning members 51 are disposed opposite to the stopper 52 with respect to the sliding direction of the slide case 4 or the guide piece 4*b*.

The above-mentioned seal case 21 situated at the arrangement location X, which is illustrated in FIGS. 3 and 4, is pressed toward the stopper 52 by the contact portions 51*a* serving as the pressing portions of the respective positioning members 51.

Figure 5:
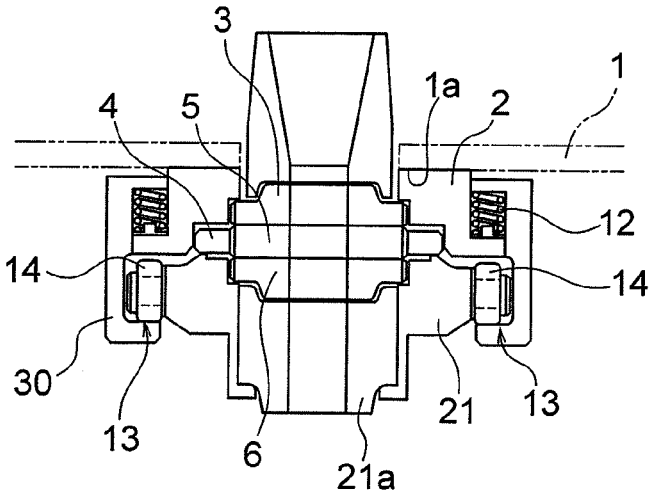
FIG. 5 A sectional view taken in the arrow A direction of FIG. 4.

Note that, regarding the movement of the seal case 21 by the pusher 53 from the above-mentioned release position (FIGS. 1 and 2) of the seal case 21 to a fully closed position (FIGS. 3 and 4) that is a use position, as illustrated in FIG. 5, a spring holder 30 is operably held on the base frame 2 through the intermediation of springs 12, and movable members 14 such as rollers, which are provided on both sides of the seal case 21, are slidably joined to support surfaces 13 formed in bottom surfaces of the spring holder 30. Therefore, the sliding movement of the seal case 21 causes the movable members 14 to move on the support surfaces 13. Accordingly, the spring holder 30 moves upward and downward to apply and release the surface pressure.

Figure 7:
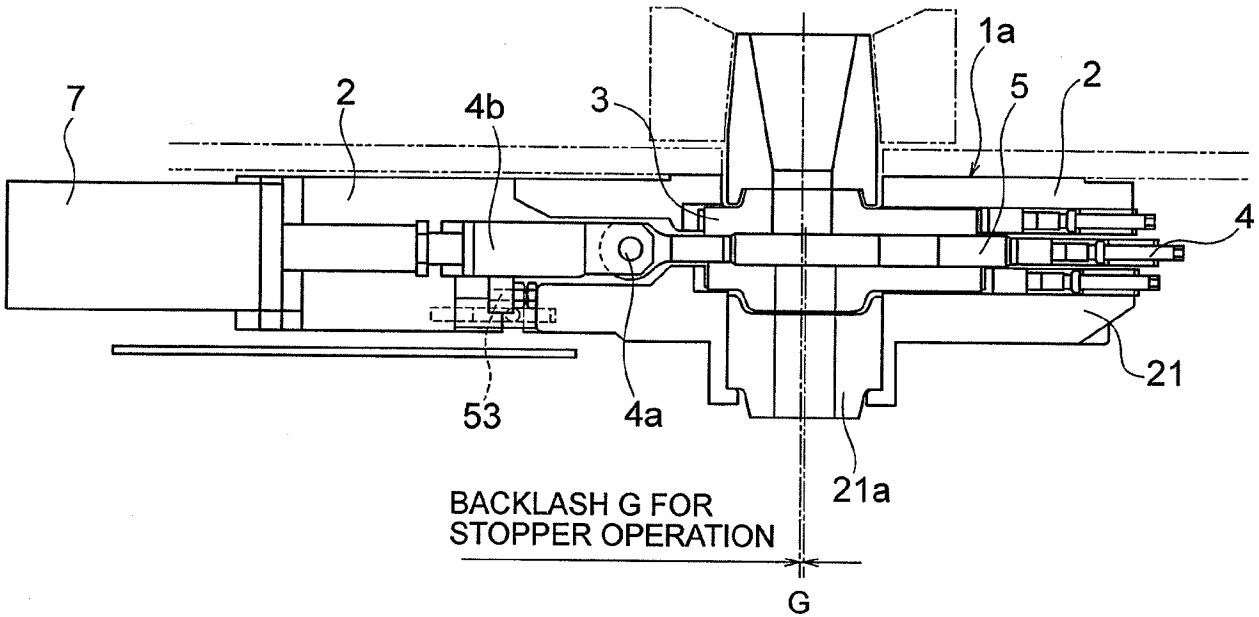
FIG. 7 A sectional view illustrating a stopper operation of FIG. 3.
Figure 8:
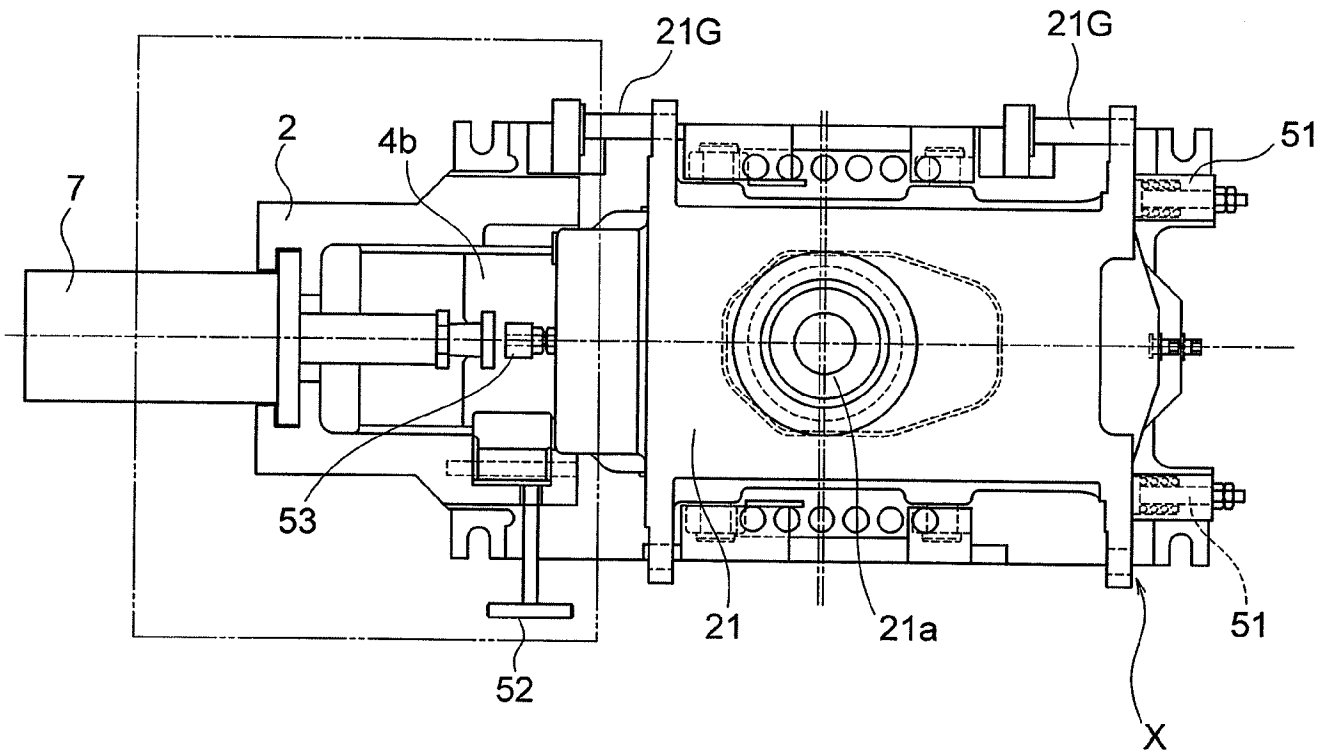
FIG. 8 A bottom view of FIG. 7.

Next, as described above, when the surface pressure is released under a state in which the seal case 21 is arranged at the arrangement location X as illustrated in FIGS. 7 and 8, the slide case 4 is temporarily slid in a direction opposite to a surface pressure release direction so that the seal case 21 situated at the arrangement location X is biased by the pusher 53 in the direction opposite to the surface pressure release direction, and the stopper 52 that is easy to operate in this state is pivoted toward the dotted line of FIG. 6 and released. Then, the slide case 4 and the seal case 21 are slid in the surface pressure release direction, with the result that the surface pressure can be released.

Next, FIGS. 10 to 13 illustrate a second embodiment of the present invention, which is different from the above-mentioned first embodiment illustrated in FIGS. 1 to 8. The same components as those in the first embodiment are represented by the same reference symbols to omit description thereof, and thus only differences from the first embodiment are described.

Specifically, in the second embodiment described above, the positioning member 51 and the pusher 53 of the first embodiment are arranged in an opposite manner. The positioning member 51 is positioned on the actuator 7 side of the base frame 2, and the pusher 53 is provided on a tip end 4A side of the slide case 4, which is opposite to the actuator 7. Similarly, the stopper 52 is disposed at a position opposite to the case of FIG. 1, that is, on the tip end 4A side of the base frame 2, which is a position opposite to the position of the actuator 7.

Figure 10:
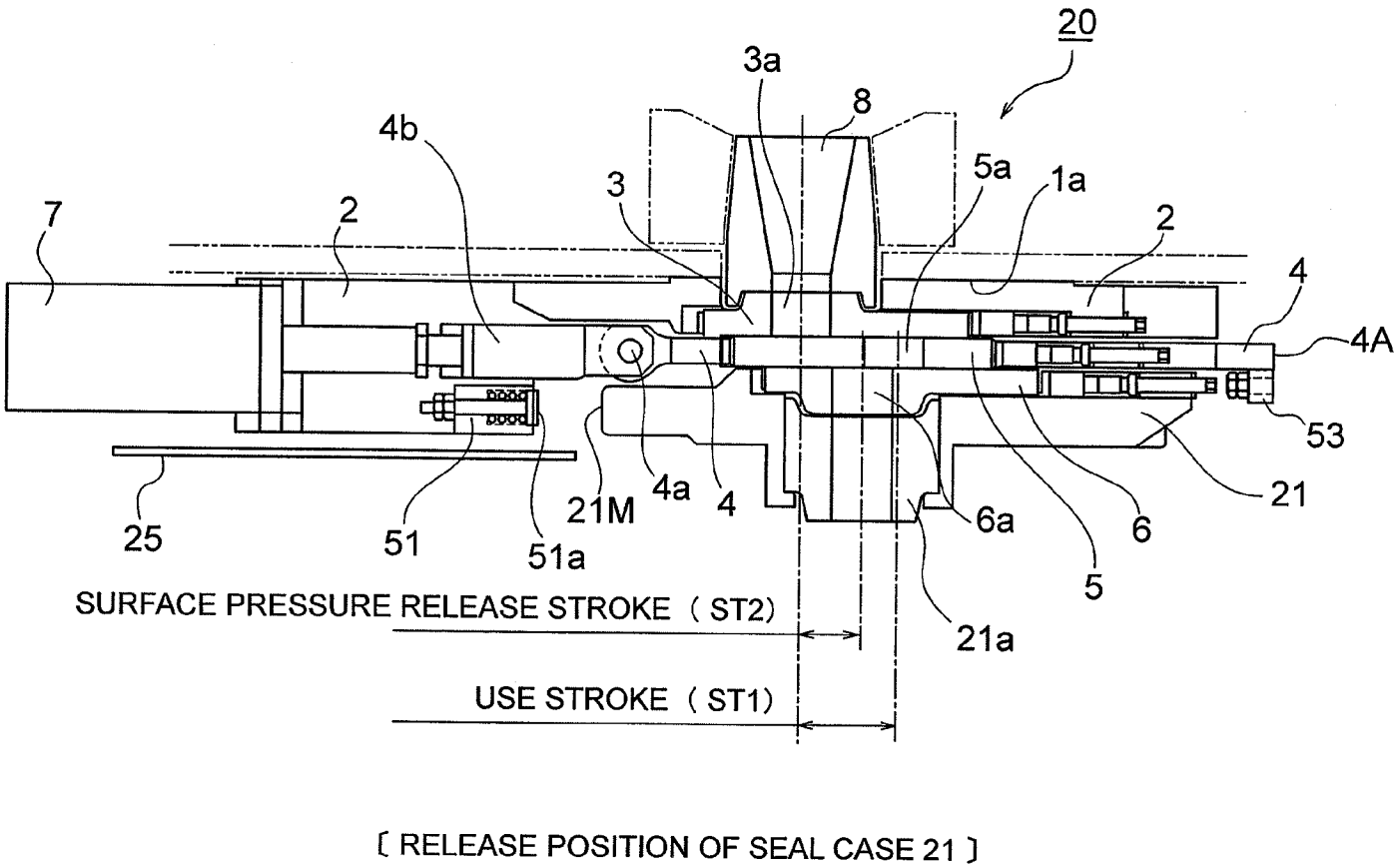
FIG. 10 A sectional view illustrating another embodiment of FIG. 1.
Figure 11:
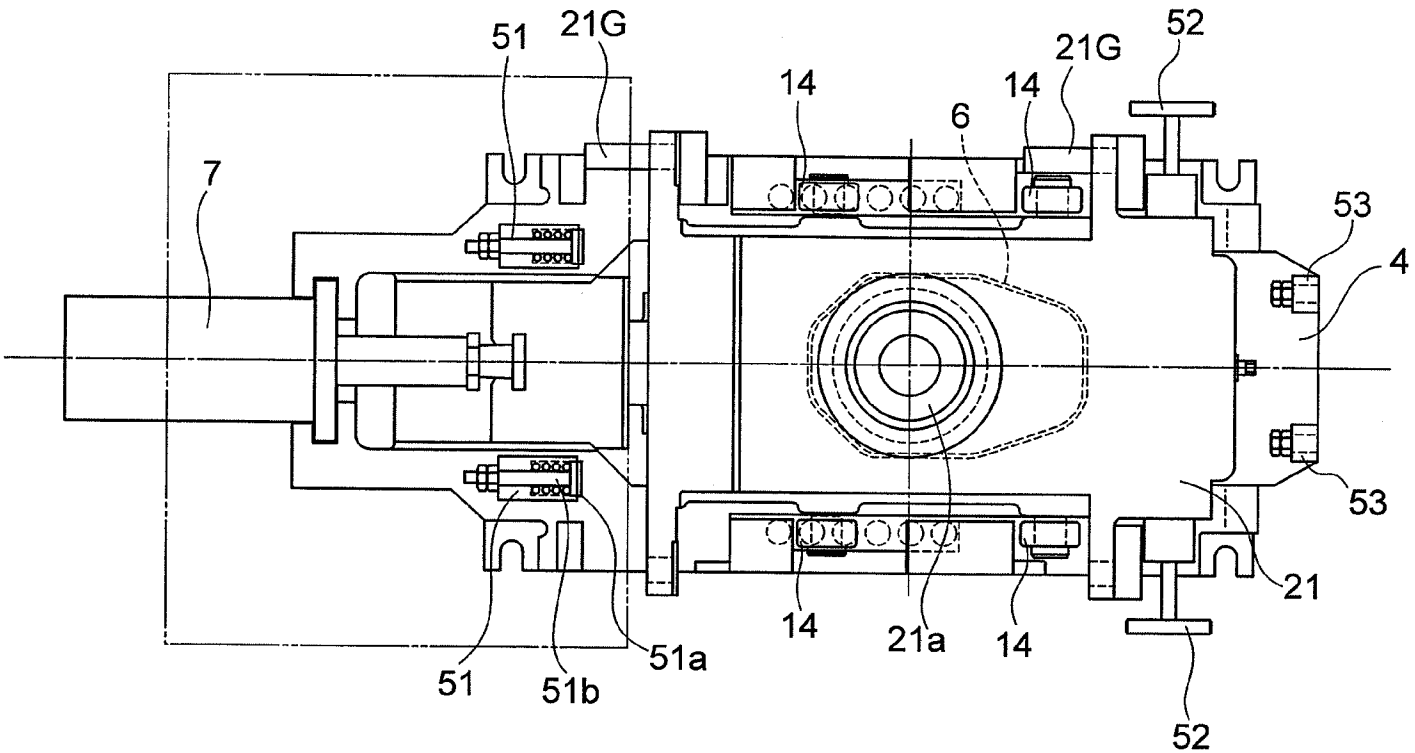
FIG. 11 A bottom view of FIG. 10.
Figure 12:
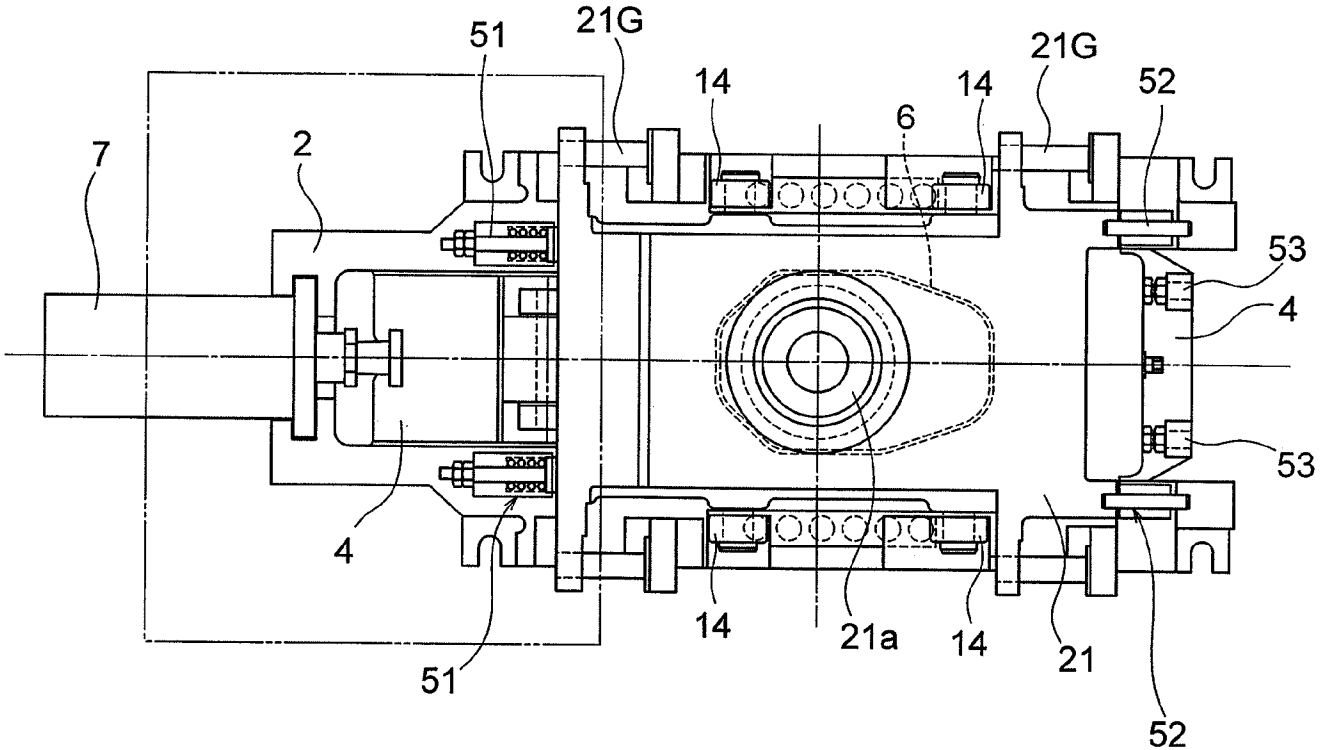
FIG. 12 An operational view of FIG. 11.
Figure 13:
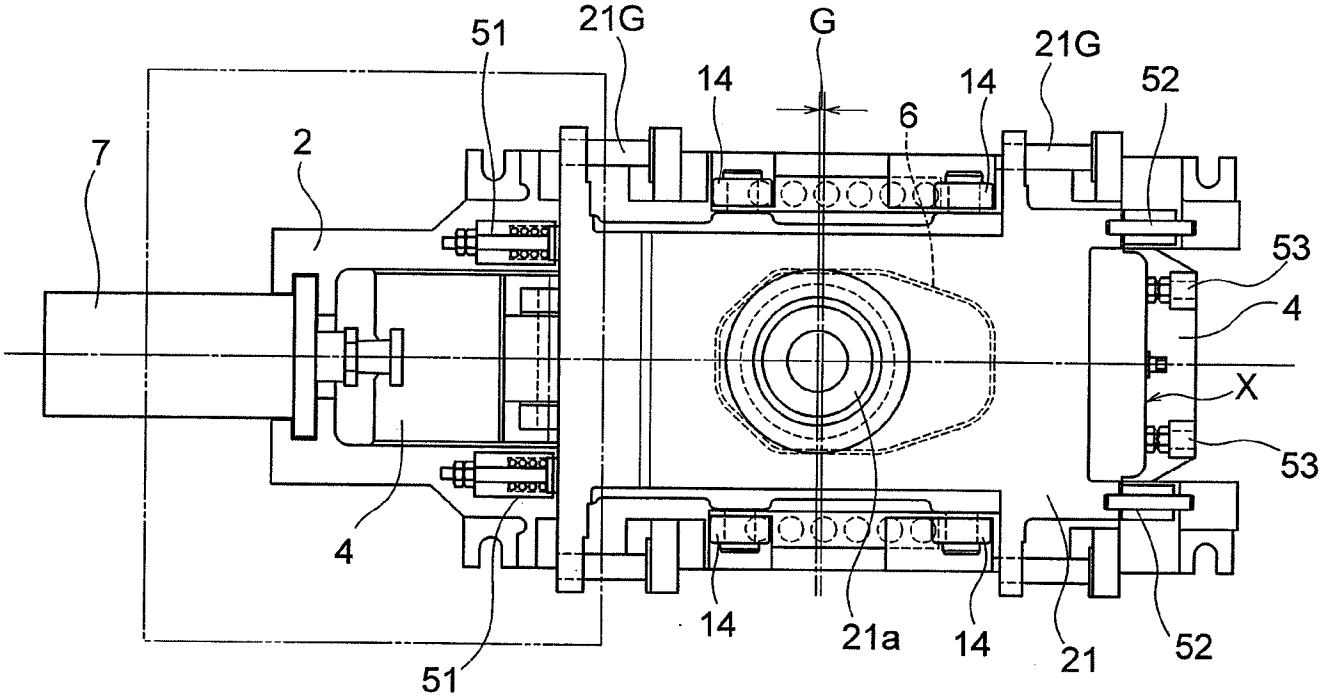
FIG. 13 An operational view of FIG. 12.
Figure 14:
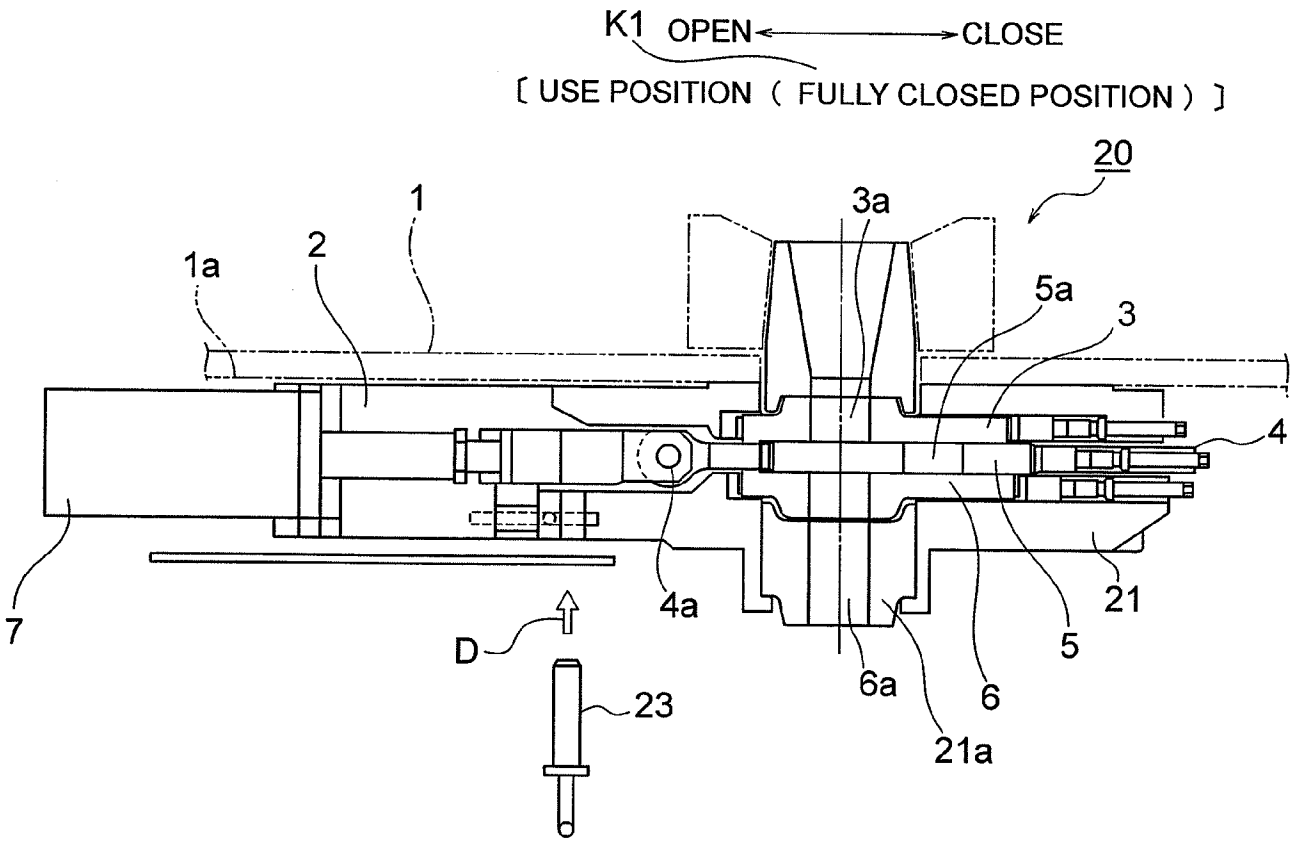
FIG. 14 A sectional view of a conventional slide valve device for automatic surface pressure application.
Figure 15:
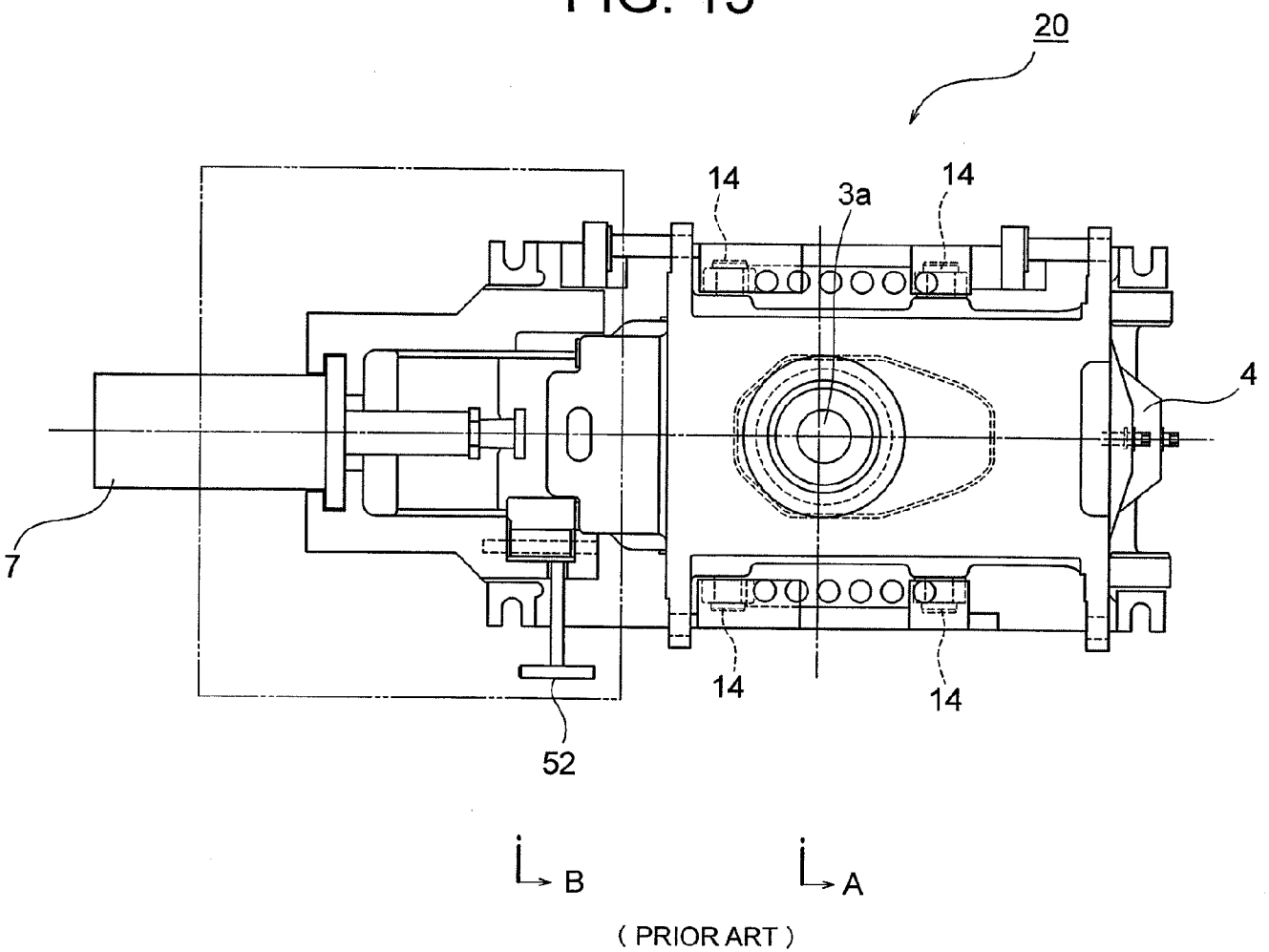
FIG. 15 A bottom view of FIG. 14.
Figure 16:
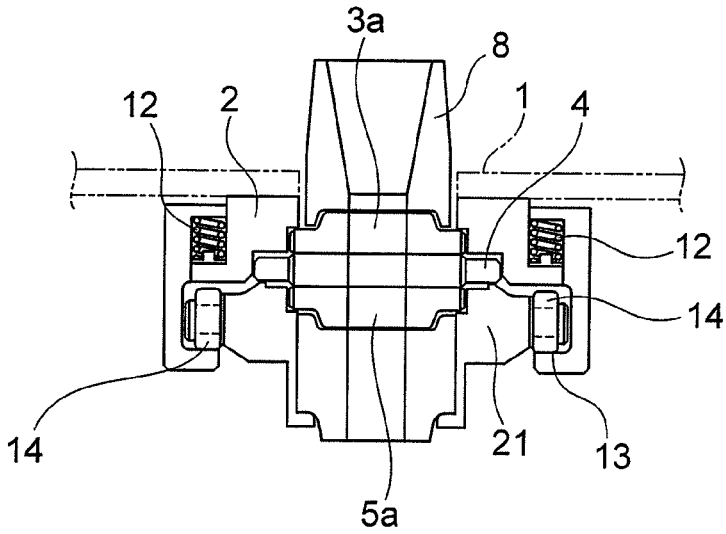
FIG. 16 A sectional view taken in the arrow A direction of FIG. 15.
Figure 17:
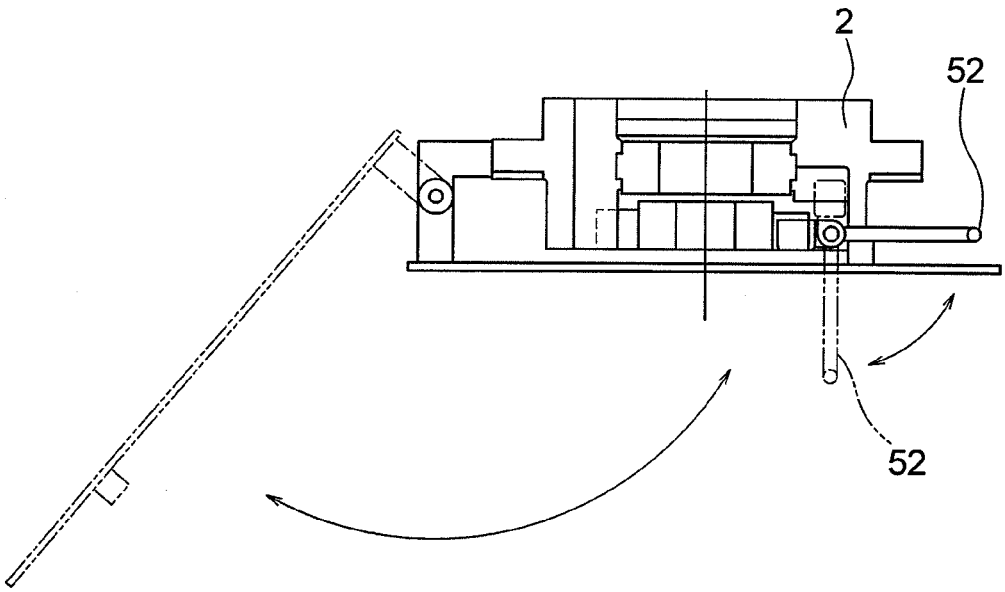
FIG. 17 A sectional view taken in the arrow B direction of FIG. 15.

Thus, in the second embodiment described above, the slide case 4 is drawn by the actuator 7 toward the left of FIG. 10 so that the seal case 21 is moved toward the left together with the seal plate 6 by the pusher 53, and a tip end 21M (illustrated in FIG. 10) of the seal case 21 abuts against the contact portions 51*a* of the positioning members 51, with the result that the surface pressure is applied in a manner similar to the case described above. The subsequent operation for the positioning members 51 is similar to that in the first embodiment described above, and description thereof is therefore omitted herein.

Industrial Applicability

The slide valve device for automatic surface pressure application and the surface pressure application method therefor according to the present invention are employed as means for controlling outflow of a molten metal between the respective vessels or the like in continuous casting facilities.

The invention claimed is:

1. A surface pressure application method for a slide valve device for automatic surface pressure device, the slide valve device for automatic surface pressure application including:

a fixed plate (3) fixed inside a base frame (2) that is mounted onto a bottom lower surface (l*a*) of a molten metal vessel (1);

a slide case (4) including a slide plate (5), the slide case (4) being provided below the fixed plate (3) so as to be slidable by an actuator (7);

a seal case (21) provided below the slide case (4), the seal case (21) including a seal plate (6) or including a seal plate (6) and a shooting nozzle (21*a*); and a movable member (14) provided to each side portion of the seal case (21) so as to be movable on a support surface (13) situated at each side portion of the base frame (2), the slide case (4) and the seal case (21) being slidable by the actuator (7) so that a surface pressure is appliable and releasable, the base frame (2) of the slide valve device for automatic surface pressure application including:

a positioning member (51) for determining an arrangement location (X) of the seal case (21); and a stopper (52) for fixing the seal case (21) at the arrangement location (X), the slide case (4) or a guide piece of the slide valve device for automatic surface pressure application including a pusher (53) for pushing the seal case (21), the surface pressure application method comprising:

sliding the slide case (4) in a surface pressure application direction to move the seal case (21) to the arrangement location (X) together with the slide case (4) through the intermediation of the pusher (53); and fitting the stopper (52) to the seal case (21) that has been moved to the arrangement location (X) to fix the seal case (21) at the arrangement location (X).

2. A slide valve device for automatic surface pressure device, comprising:

a fixed plate (3) fixed inside a base frame (2) that is mounted onto a bottom lower surface (l*a*) of a molten metal vessel (1);

a slide case (4) including a slide plate (5), the slide case (4) being provided below the fixed plate (3) so as to be slidable by an actuator (7);

a seal case (21) provided below the slide case (4), the seal case (21) including a seal plate (6) or including a seal plate (6) and a shooting nozzle (21*a*); and a movable member (14) provided to each side portion of the seal case (21) so as to be movable on a support surface (13) situated at each side portion of the base frame (2), the slide case (4) and the seal case (21) being slidable by the actuator (7) so that a surface pressure is appliable and releasable, wherein the base frame (2) comprises:

a positioning member (51) for determining an arrangement location (X) of the seal case (21); and a stopper (52) for fixing the seal case (21) at the arrangement location (X), and wherein the slide case (4) or a guide piece comprises a pusher (53) for sliding the seal case (21) together with the slide case (4) when sliding the slide case (4) in a surface pressure application direction.

3. A slide valve device for automatic surface pressure device according to claim 2, wherein the positioning member (51) and the stopper (52) are arranged so as to sandwich the seal case (21) with respect to a sliding direction of the slide case (4).

4. A slide valve device for automatic surface pressure device according to claim 3, wherein a contact portion (51*a*) of the positioning member (51) with respect to the seal case (21) forms a pressing portion having elasticity.

5. A slide valve device for automatic surface pressure device according to claim 2, wherein a contact portion (51*a*) of the positioning member (51) with respect to the seal case (21) forms a pressing portion having elasticity.

* * * * *